US008171737B2

(12) United States Patent
Johnson et al.

(10) Patent No.: US 8,171,737 B2
(45) Date of Patent: May 8, 2012

(54) COMBUSTOR ASSEMBLY AND CAP FOR A TURBINE ENGINE

(75) Inventors: Thomas Edward Johnson, Greer, SC (US); Patrick Melton, Horse Shoe, NC (US)

(73) Assignee: General Electric Company, Schenectady, NY (US)

( * ) Notice: Subject to any disclaimer, the term of this patent is extended or adjusted under 35 U.S.C. 154(b) by 644 days.

(21) Appl. No.: 12/355,047

(22) Filed: Jan. 16, 2009

(65) Prior Publication Data

US 2010/0180602 A1 Jul. 22, 2010

(51) Int. Cl.
*F02C 1/00* (2006.01)

(52) U.S. Cl. ..... 60/760; 60/752; 60/804

(58) Field of Classification Search ..... 60/804, 60/746, 747, 752–760
See application file for complete search history.

(56) References Cited

U.S. PATENT DOCUMENTS 5,323,600 A * 6/1994 Munshi ..... 60/772
6,438,959 B1 * 8/2002 Dean et al. ..... 60/760

* cited by examiner

*Primary Examiner* — Ehud Gartenberg
*Assistant Examiner* — Carlos A Rivera
(74) *Attorney, Agent, or Firm* — Nixon & Vanderhye P.C.

(57) ABSTRACT

A combustor assembly for a turbine engine includes a cap assembly which gradually increases the volume of compressed air provided to the combustor assembly, and which slows the compressed air in a controlled manner before delivering the compressed air into a combustor area. The cap assembly includes inner and outer sleeves which are mounted in a concentric fashion. The annular space formed between the inner and outer sleeves gradually increases from an aft end to a forward end. A stepped portion is formed on the inner sleeve of the cap assembly, and this stepped portion is joined to a corresponding combustor liner.

16 Claims, 5 Drawing Sheets

COMBUSTOR ASSEMBLY AND CAP FOR A TURBINE ENGINE

The disclosure relates to turbine engines, and in particular, to the combustor section of a turbine engine and related hardware.

BACKGROUND OF THE INVENTION

In a typical turbine engine used in a power generating plant, incoming air is compressed, and the compressed air is then routed to a plurality of combustor assemblies which are arrayed around the periphery of the engine. In each combustor assembly, fuel is added to the compressed air, and the air-fuel mixture is ignited. The resulting expanding gases are then routed to the turbine blades to produce a rotational force.

In a typical combustor assembly for such a turbine engine, a generally cylindrical flow sleeve surrounds the outer portion of part of the assembly. A generally cylindrical combustor liner is concentrically mounted inside the flow sleeve. Air from the compressor section of the turbine engine is routed through the annular space between the exterior surface of the combustor liner and the interior surface of the flow sleeve.

A combustor casing is attached to the end of the flow sleeve. A cap assembly is mounted inside the combustor casing. The cap assembly includes an inner sleeve that is concentrically mounted inside an outer sleeve. Both the inner and outer sleeves are generally cylindrical in configuration.

The end of the combustor liner surrounds and is coupled to the front edge of the inner sleeve of the cap assembly. Compressed air flowing in the annular space between the combustor liner and the flow sleeve passes into an annular space formed between the inner sleeve and outer sleeve of the cap assembly. The air then makes an approximately 180° turn, and the air then passes by a plurality of fuel injectors, where fuel is added to the compressed air. The air-fuel mixture passes through the inner portion of the cap assembly, inside the inner sleeve, and then out into the combustor liner, at which point the air-fuel mixture is ignited. The combustion gases then pass through the inside of the combustor liner.

Elements attached to the combustor liner and the cap assembly are used to properly position the flow sleeve and the combustor liner with respect to the cap assembly and the combustor casing. A liner stop is welded to the inner surface of the outer sleeve of the cap assembly. An end of the liner stop abuts and engages a lug which is attached to the exterior surface of the combustor liner. Abutment of the liner stop against the lug locates the end of the combustor liner and the flow sleeve with respect to the combustor casing and the cap assembly. The abutment also prevents relative rotation between these elements.

The combustor assembly described above suffers from several inefficiencies. First, the liner stop and lug are located directly in the flow path of the compressed air passing from the annular space between the combustor liner and the flow sleeve into the annular space between the inner sleeve and outer sleeve of the cap assembly. This impedes the air flow, and also introduces turbulent flow patterns around each liner stop and lug location. In addition, the liner stop and lug tend to experience wear, and they require periodic maintenance.

In addition, as the flow of compressed air passes from the annular space between the combustor liner and flow sleeve into the annular space between the inner sleeve and outer sleeve of the cap assembly, the compressed air experiences a sudden expansion. More specifically, because the outer diameter of the end of the combustor liner is greater than the outer diameter of the inner sleeve of the cap, there is a sudden expansion as the compressed air passes over the end of the combustor liner.

In addition, as the compressed air exits the cap assembly and is dumped into the plenum area within the combustor casing, the air experiences another even greater expansion.

These sudden expansions cause shearing between varying velocity air streams, and this shearing causes parasitic losses which reduce the overall efficiency of the turbine engine. The shearing that occurs as a result of these sudden expansions generate friction and heat which serve no purpose, and thus result in energy losses. Also, the heating caused by this shearing tends to reduce the density of the compressed air, which also lowers the efficiency of the turbine.

BRIEF DESCRIPTION OF THE INVENTION

In one aspect, the invention may be embodied in a combustor assembly for a turbine engine that includes a generally cylindrical flow sleeve, a generally cylindrical combustor liner that is concentrically mounted inside the flow sleeve, wherein compressed air flows through a space formed between an exterior of the combustor liner and an interior of the flow sleeve. The combustor assembly also includes a generally cylindrical combustor casing attached to an end of the flow sleeve. A cap is mounted in the combustor casing, the cap including a generally cylindrical outer sleeve and a generally cylindrical inner sleeve that is concentrically mounted inside the outer sleeve. An end of the combustor liner is coupled to an aft end of the inner sleeve such that compressed air flowing between the flow sleeve and the combustor liner flows into a space between the inner and outer sleeves of the cap. A diameter of the inner sleeve gradually decreases from the aft end of the inner sleeve towards a forward end of the inner sleeve.

In another aspect, the invention may be embodied in a cap for a combustor assembly of a turbine engine that includes a generally cylindrical outer sleeve and a generally cylindrical inner sleeve that is concentrically mounted inside the outer sleeve, wherein compressed air can flow through an annular space located between the inner sleeve and the outer sleeve, and wherein a diameter of the inner sleeve gradually decreases from a first end of the inner sleeve towards a second opposite end of the inner sleeve.

In another aspect, the invention may be embodied in a cap for a combustor assembly of a turbine that includes a generally cylindrical outer sleeve and a generally cylindrical inner sleeve that is concentrically mounted inside the outer sleeve, wherein compressed air can flow through an annular space located between the inner and outer sleeves, wherein a first end of the inner sleeve of the cap has a step that includes a small diameter portion and a large diameter portion, and wherein the small diameter portion is configured to be coupled to an end of a combustor liner.

DETAILED DESCRIPTION OF PREFERRED EMBODIMENTS

Figure 1:
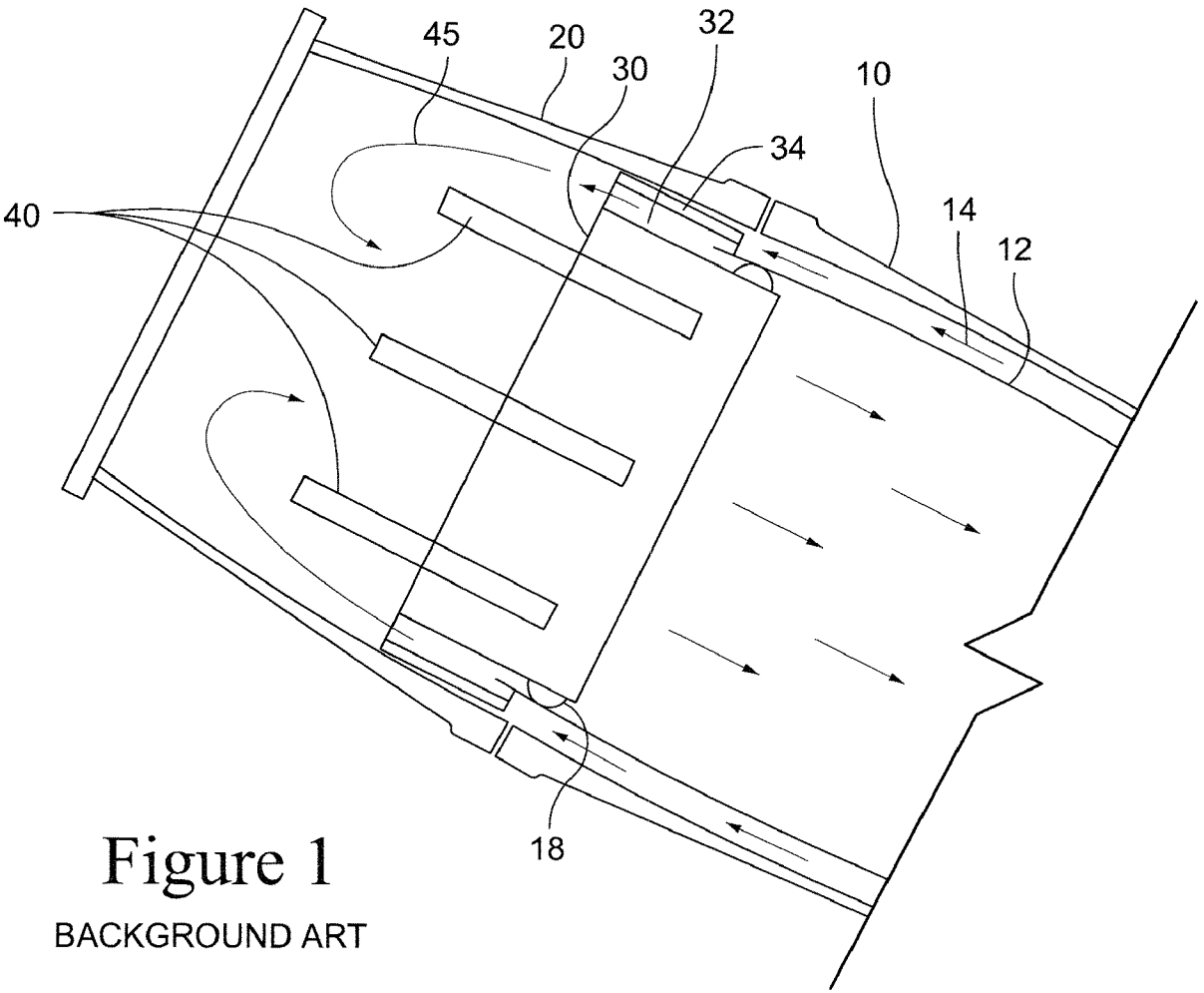
Figure 1 BACKGROUND ART
FIG. 1 is a diagram of a combustor assembly of a background art turbine engine.

FIG. 1 shows a typical background art combustor assembly for such a turbine engine. As seen in FIG. 1, a generally cylindrical flow sleeve 10 surrounds the outer portion of part of the assembly. A generally cylindrical combustor liner 12 is concentrically mounted inside the flow sleeve 10. Air from the compressor section of the turbine engine is routed through the annular space between the exterior surface of the combustor liner 12 and the interior surface of the flow sleeve 10. The arrows 14 in FIG. 1 denote the flow direction of the compressed air as it enters the combustor assembly.

A combustor casing 20 is attached to the end of the flow sleeve 10. A cap assembly 30 is mounted inside the combustor casing 20. The cap assembly 30 includes an inner sleeve 32 that is concentrically mounted inside an outer sleeve 34. Both the inner and outer sleeves are generally cylindrical in configuration.

The end of the combustor liner 12 surrounds and is coupled to the front edge of the inner sleeve 32 of the cap assembly 30. A seal 18 is positioned between the exterior surface of the inner sleeve 32 and the inner surface of the combustor liner 12.

Compressed air flowing in the annular space between the combustor liner 12 and the flow sleeve 10 passes into an annular space formed between the inner sleeve 32 and outer sleeve 34 of the cap assembly 30. The air then makes an approximately 180° turn, as noted by the arrows 45 in FIG. 1. The air then passes into a plurality of fuel injectors 40, where fuel is added to the compressed air. The fuel injectors are located inside the inner portion of the cap assembly, inside the inner sleeve 32. The fuel-air mixture then passes into the combustor liner, where it is ignited.

Figure 2A:
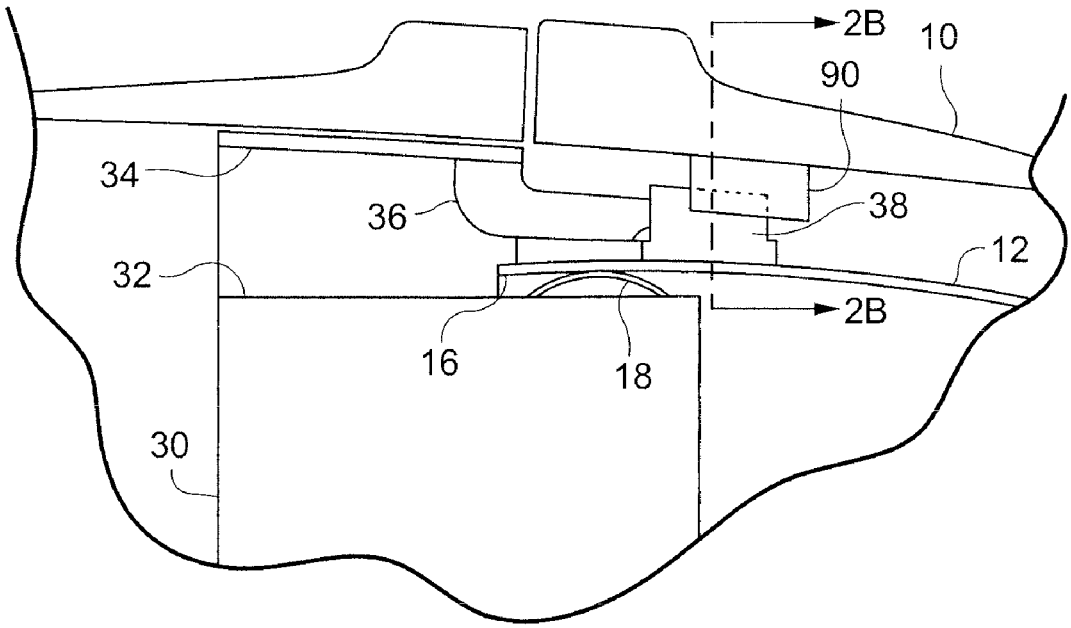
Figure 2a BACKGROUND ART
FIG. 2A is a diagram illustrating the interface between a flow sleeve and combustor liner and a cap assembly of the combustor assembly shown in FIG. 1.

FIG. 2A shows an enlarged view of how the cap assembly joins to the combustor liner 12. As shown therein, the end of the combustor liner 12 surrounds the outer surface of the inner sleeve 32 of the cap assembly 30. A seal 18 is located between the inner surface of the combustor liner 12 and the outer surface of the inner sleeve 32.

FIG. 2A also shows the elements which are used to properly position the flow sleeve 10 and the combustor liner 12 with respect to the cap assembly 30 and the combustor casing 20. A liner stop 36 is rigidly attached to the inner surface of the outer sleeve 34 of the cap assembly 30. An end of the liner stop 36 abuts and engages a lug 38 which is attached to the exterior surface of the combustor liner 12. Abutment of the liner stop 36 against the lug 38 locates the end of the combustor liner 12 and the flow sleeve 10 with respect to the combustor casing 20 and the cap assembly 30.

Figure 2B:
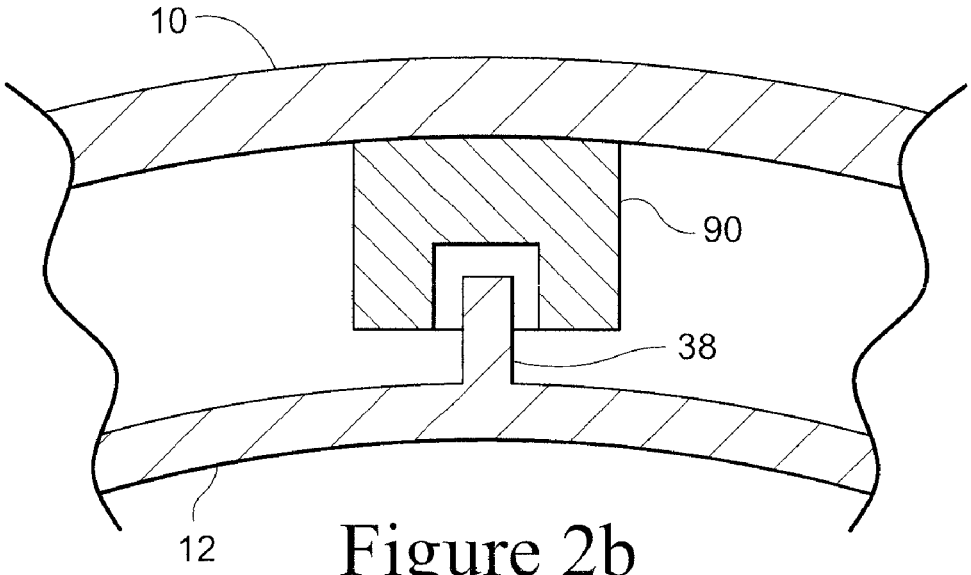
Figure 2b BACKGROUND ART
FIG. 2B is a sectional view illustrating elements that prevent the combustor liner from rotating with respect to the flow sleeve.

As shown in FIG. 2B, the lug 38 on the combustor liner 12 also slidingly engages with a pocket 90 on the inner surface of the flow sleeve 10. The engagement between the lug 38 and the pocket 90 prevents the combustor liner 12 from rotating with respect to the flow sleeve 10.

The combustor assembly described above suffers from several inefficiencies. First, the liner stop 36, lug 38 and pocket 90 are all located directly in the flow path of the compressed air passing from the annular space between the combustor liner 12 and the flow sleeve 10 into the annular space between the inner sleeve 32 and outer sleeve 34 of the cap assembly 30. This impedes the air flow, and also introduces turbulent flow patterns around each liner stop, lug and pocket location. In addition, the liner stop 36 and lug 38 tend to experience wear, and they require periodic maintenance.

In addition, as the flow of compressed air passes from the annular space between the combustor liner 12 and flow sleeve 10 into the annular space between the inner sleeve 32 and outer sleeve 34 of the cap assembly, the compressed air experiences a sudden expansion. More specifically, because the outer diameter of the end 16 of the combustor liner 12 is greater than the outer diameter of the inner sleeve 32 of the cap, there is a sudden expansion as the compressed air passes over the end 16 of the combustor liner 12.

Moreover, as the compressed air exits the cap assembly and is dumped into the plenum area within the combustor casing 20, the air experiences another even greater expansion.

Figure 3:
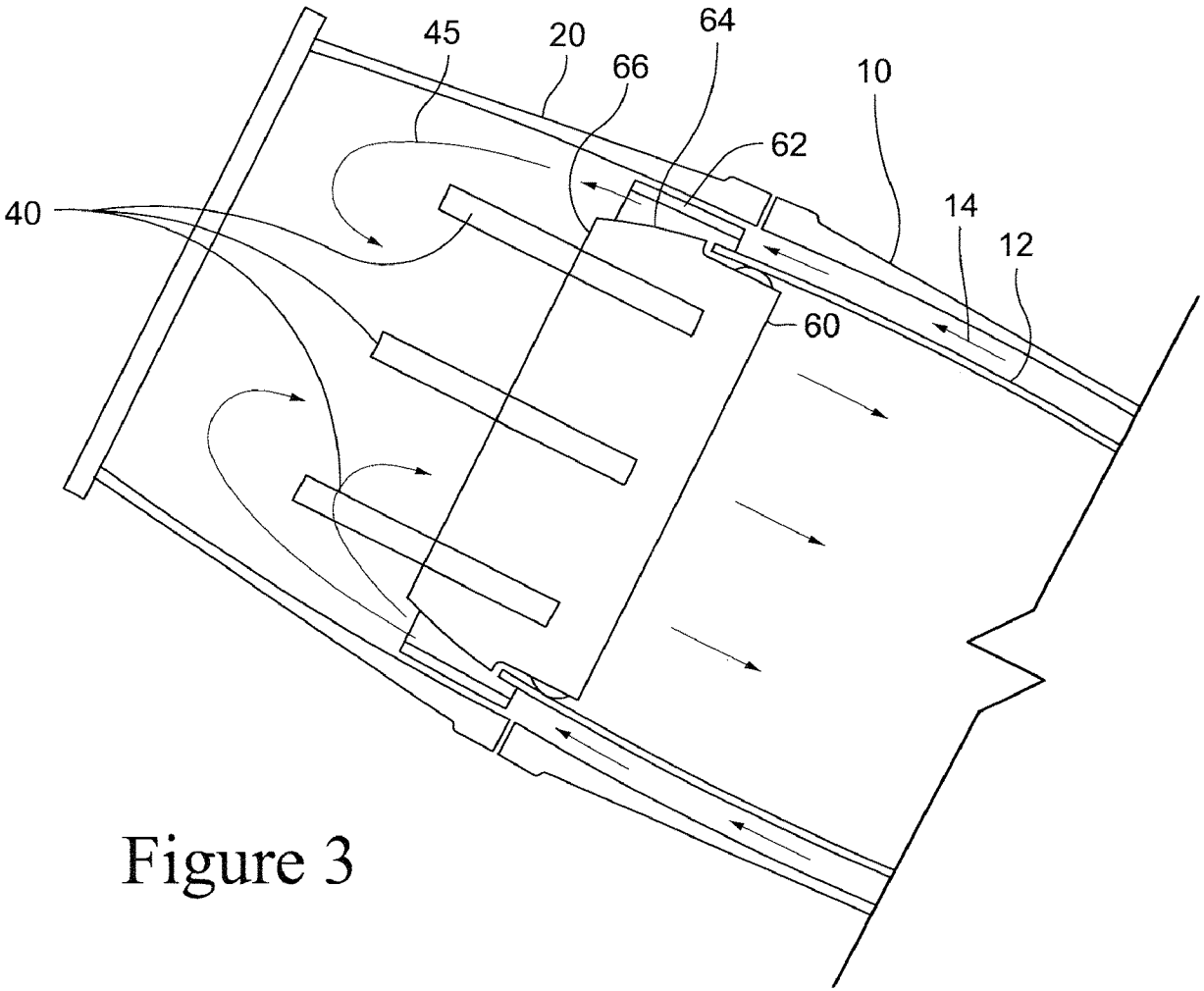
FIG. 3 is a diagram illustrating a first embodiment of a combustor assembly with a cap assembly.

FIG. 3 illustrates a first embodiment of a combustor assembly which provides improved air flow compared to the combustor assembly illustrated in FIGS. 1 and 2. This combustor assembly still includes a flow sleeve 10 and a combustor liner 12. As before, incoming compressed air moves through the annular space between the combustor liner 12 and flow sleeve 10, as shown by the arrows 14. In this embodiment, a cap assembly 60 includes an outer sleeve 62 and an inner sleeve 64. This cap assembly is shown in greater detail in FIGS. 4A, 4B and 5.

Figure 4A:
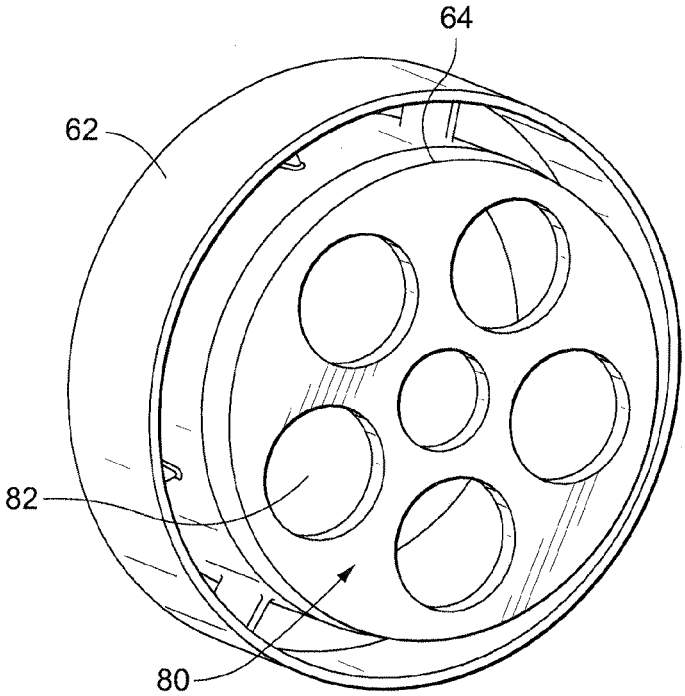
FIGS. 4A and 4B are perspective views of the cap assembly shown in FIG. 3.
Figure 4B:
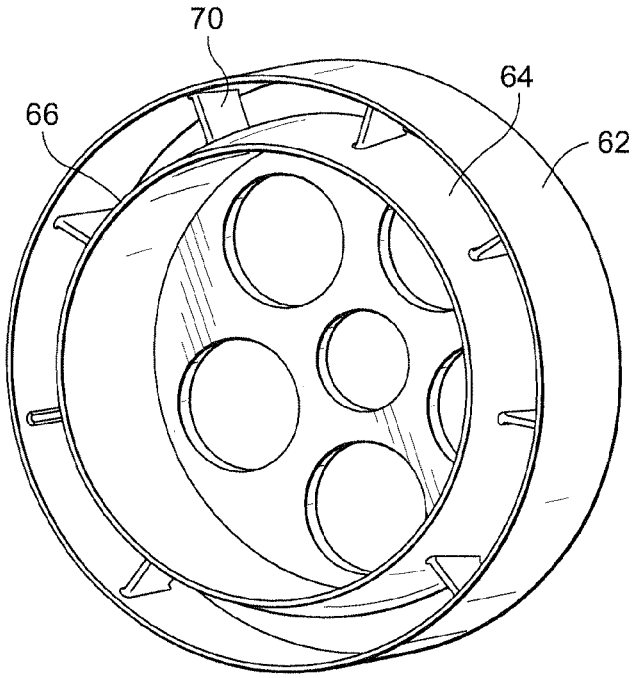

As shown in FIGS. 4A and 4B, the cap assembly includes an effusion plate 80 which includes a plurality of apertures 82. The fuel injectors 40 would be located at positions corresponding to approximately the centers of each of the apertures 82.

The generally cylindrical inner sleeve 64 is concentrically mounted inside the outer sleeve 62. A plurality of support struts 70 extend between the inner and outer sleeves. As best seen in FIG. 3, the outside diameter of the inner sleeve 64 gradually becomes smaller from the effusion plate end or aft end to the forward end 66.

Because the outside diameter of the inner sleeve 64 of the cap assembly 60 gradually decreases from the aft end which is joined to the combustor liner 12 to the forward end 66, the annular space formed between the inner sleeve 64 and outer sleeve 62 gradually becomes larger from the aft end of the cap assembly to the forward end of the cap assembly. In other words, there is no sudden, sharp or instantaneous expansion of this annular space, as occurs in the background art combustor assembly described above. Accordingly, the volume of the compressed air moving through this space in the direction of the flow arrows in FIG. 3 will increase in a gradual and controlled fashion.

This gradual increase in the volume of the air is in direct contrast to the sudden expansions that occur when compressed air is moving through the corresponding space in the background art combustor cap shown in FIGS. 1 and 2. This controlled expansion also gradually slows the compressed air before the air is dumped into the plenum area inside the combustor casing 20, all of which helps to prevent the parasitic flow losses which occur in the background art combustor assemblies.

In the embodiment discussed above, the inner sleeve has a gradually decreasing outer diameter, which results in the annular space between the inner and outer sleeves of the cap gradually increasing in volume from the aft end of the cap to the forward end of the cap. However, in alternate embodiments, this same effect could be achieved in different ways. For instance, the diameter of the outer sleeve could increase and the diameter of the inner sleeve could remain substantially the same. In still other embodiments, the diameter of the inner sleeve could gradually decrease while the diameter of the outer sleeve could gradually increase. Both of these alternate arrangements would also result in a gradual and controlled expansion in the compressed air passing through the annular space between the inner and outer sleeves as the compressed air passes from the aft end to the forward end of the cap.

Figure 5:
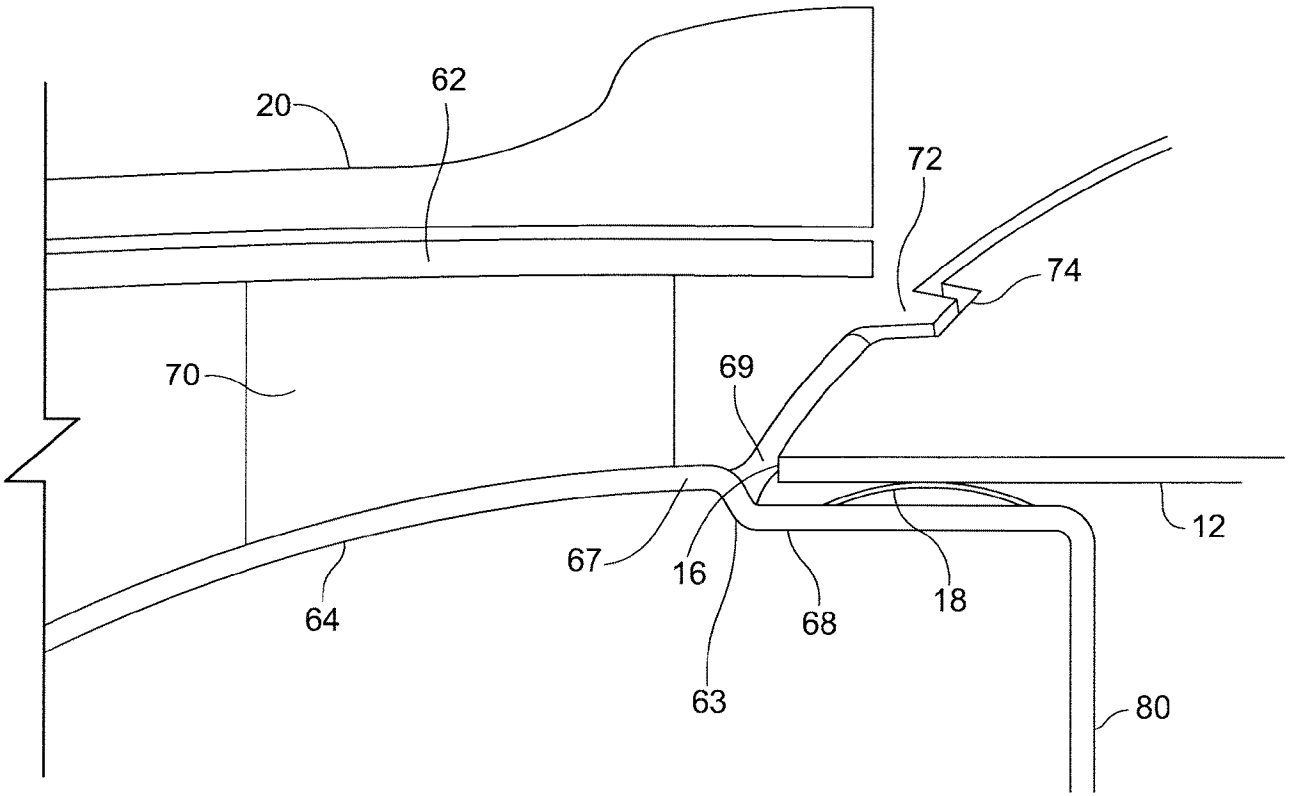
FIG. 5 is a partial perspective view showing an embodiment of an interface between a combustor liner and cap assembly of a combustor assembly.

In addition, the combustor liner 12 is mated to a stepped portion of the aft end of the inner sleeve 64 of the cap assembly. FIG. 5 shows the interface between the combustor liner 12 and the inner sleeve 64 of the cap assembly 60 in greater detail. As shown therein, the aft edge of the inner sleeve 64 of the cap assembly 60 includes a stepped portion. The stepped portion includes a larger diameter portion 67 and a smaller diameter portion 68 joined by a step 63. The end of the combustor liner 12 surrounds the smaller diameter portion 68 of the inner sleeve 64. A seal 18 is located between the outer surface of the smaller diameter portion 68 of the inner sleeve 64 and the inner surface of the combustor liner 12.

The outer diameter of the combustor liner is approximately equal to the outer diameter of the larger diameter portion 67 of the inner sleeve 64. Consequently, air flowing past the interface between the end 16 of the combustor liner 20 and the inner sleeve 64 of the cap does not experience a sudden increase in volume, as is the case the background art combustor assemblies as illustrated in FIGS. 1 and 2. This feature also helps to prevent parasitic losses.

The step 63 formed on the inner sleeve 64 of the cap assembly can also function to properly locate the combustor liner 12 with respect to the cap assembly 60 and the combustor casing 20. Specifically, the step 63 forms a bearing surface 69 that the end 16 of the combustor liner 12 abuts. The abutment of the end 16 of the combustor liner 12 with the bearing surface 69 of the step 63 around the circumference of the combustor liner 12 properly locates the elements with respect to each other.

In addition, a projection 72 can be formed on the inner sleeve 64 of the cap assembly 60, and a corresponding recess 74 can be formed at the end 16 of the combustor liner 12. The projection 72 is received in the recess 74. As a result, the combustor liner 12 is not able to rotate with the respect to the cap assembly 60. This anti-rotation function could be performed with alternate arrangements of projections and recesses. For instance, the projection could be formed on the end of the combustor liner 12, and the recess could be formed on the inner sleeve 64 of the cap assembly. In addition, although the embodiment shown in FIG. 5 has the projections and recesses extending in a longitudinal axial direction, these projections and recesses could also be formed in a radial direction.

The use of the stepped inner sleeve of the cap mating to the combustor liner, and the projection and recesses to prevent relative rotation, eliminates the need for the liner stops, lugs and pockets in the background art combustor assemblies. Eliminating the liner stops, lugs and pockets also reduces parasitic losses and the need for periodic maintenance on those items. The new configuration also reduces the overall cost of the combustor assembly.

The reduction in parasitic losses helps engine efficiency in multiple ways. First, the reduction in parasitic losses should result in less work required to flow a given volume of compressed air through the combustor. In addition, because the shearing that occurs in background art combustor assemblies causes heat, and because the shearing is reduced, the compressed air will be delivered to the combustor chamber at a lower temperature, which also boosts engine efficiency.

While the invention has been described in connection with what is presently considered to be the most practical and preferred embodiments, it is to be understood that the invention is not to be limited to the disclosed embodiments, but on the contrary, is intended to cover various modifications and equivalent arrangements which are encompassed within the spirit and scope of the appended claims.

What is claimed is:

1. A combustor assembly for a turbine, comprising:

a generally cylindrical flow sleeve;

a generally cylindrical combustor liner that is concentrically mounted inside the flow sleeve, wherein compressed air flows through a space formed between an exterior of the combustor liner and an interior of the flow sleeve;

a generally cylindrical combustor casing attached to an end of the flow sleeve; a cap mounted in the combustor casing, the cap including a generally cylindrical outer sleeve and a generally cylindrical inner sleeve that is concentrically mounted inside the outer sleeve, wherein an end of the combustor liner is coupled to an aft end of the inner sleeve such that compressed air flowing between the flow sleeve and the combustor liner flows into a space between the inner and outer sleeves of the cap, wherein the inner and outer sleeves are positioned with respect to each other such that a volume of the air passing through the space between the inner and outer sleeves gradually increases as the air passes from the aft end of the cap to the forward end of the cap, wherein the aft end of the inner sleeve of the cap has a step that includes a small diameter portion and a large diameter portion, wherein the end of the combustor liner that is coupled to the inner sleeve surrounds the small diameter portion; and wherein an outside diameter of the end of the combustor liner that is coupled to the inner sleeve is substantially the same as the outside diameter of the large diameter portion of the step.

2. The combustor assembly of claim 1, wherein a diameter of the inner sleeve gradually decreases from an aft end of the inner sleeve towards a forward end of the inner sleeve.

3. The combustor assembly of claim 1, wherein the step includes a bearing surface that extends between the large diameter portion and the small diameter portion, and wherein the end of the combustor liner abuts the bearing surface to properly locate the combustor liner with respect to the cap and the combustor casing.

4. The combustor assembly of claim 3, wherein a projection is formed on one of the inner sleeve of the cap and the combustor liner, wherein a recess is formed on the other of the inner sleeve of the cap and the combustor liner, and wherein the projection is received in the recess to prevent the combustor liner from rotating with respect to the cap.

5. The combustor assembly of claim 1, wherein a projection is formed on one of the inner sleeve of the cap and the combustor liner, wherein a recess is formed on the other of the inner sleeve of the cap and the combustor liner, and wherein the projection is received in the recess to prevent the combustor liner from rotating with respect to the cap.

6. A cap for a combustor assembly of a turbine engine, comprising:

a generally cylindrical outer sleeve; and a generally cylindrical inner sleeve that is concentrically mounted inside the outer sleeve, wherein compressed air can flow through an annular space located between the inner sleeve and the outer sleeve, wherein the outer sleeve and the inner sleeve are angled with respect to each other such that a volume of air passing through the annular space gradually increases as the air passes from an aft end of the cap to a forward end of the cap, wherein the inner sleeve of the cap has a step that includes a small diameter portion and a large diameter portion, wherein the small diameter portion is configured to be inserted into an end of a combustor liner such that the end of the combustor liner surrounds the small diameter portion, and wherein an outside diameter of the large diameter portion of the step is configured to be substantially the same as the outside diameter of the end of the combustor liner that is coupled to the inner sleeve.

7. The cap of claim 6, wherein a diameter of the inner sleeve gradually decreases from an aft end of the inner sleeve towards a forward end of the inner sleeve.

8. The cap of claim 6, wherein the step includes a bearing surface that extends between the large diameter portion and the small diameter portion, and wherein the bearing surface is configured to abut an end of a combustor liner to properly locate the combustor liner with respect to the cap.

9. The cap of claim 8, wherein the inner sleeve comprises at least one projection that is configured to be received in at least one corresponding recess of a combustor liner that is coupled to the inner sleeve to prevent relative rotation between the cap and the combustor liner.

10. The cap of claim 6, wherein the inner sleeve comprises at least one projection that is configured to be received in at least one corresponding recess of a combustor liner that is coupled to the inner sleeve to prevent relative rotation between the cap and the combustor liner.

11. The cap of claim 6, wherein a diameter of at least one of the inner sleeve and the outer sleeve gradually changes from the aft end of the cap to the forward end of the cap.

12. A cap for a combustor assembly of a turbine, comprising:

a generally cylindrical outer sleeve; and a generally cylindrical inner sleeve that is concentrically mounted inside the outer sleeve, wherein compressed air can flow through an annular space located between the inner and outer sleeves, wherein a first end of the inner sleeve of the cap has a step that includes a small diameter portion and a large diameter portion, wherein the small diameter portion is configured to be inserted into an end of a combustor liner such that the end of the combustor liner surrounds the small diameter portion, and wherein the small diameter portion of the inner sleeve is configured to be mounted inside an end of a combustor liner such that an outside diameter of the large diameter portion of the inner sleeve is approximately the same as an outside diameter of the combustor liner that surrounds the small diameter portion of the inner sleeve.

13. The cap of claim 12, wherein the step includes a bearing surface that extends between the large diameter portion and the small diameter portion, and wherein the bearing surface is configured to abut an end of a combustor liner to properly locate the combustor liner with respect to the cap.

14. The cap of claim 13, wherein the inner sleeve comprises at least one projection that is configured to be received in at least one corresponding recess of a combustor liner that is coupled to the inner sleeve to prevent relative rotation between the cap and the combustor liner.

15. The cap of claim 12, wherein the step includes a bearing surface that extends between the large diameter portion and the small diameter portion, and wherein the bearing surface is configured to abut an end of a combustor liner to properly locate the combustor liner with respect to the cap.

16. The cap of claim 12, wherein the inner sleeve comprises at least one projection that is configured to be received in at least one corresponding recess of a combustor liner that is coupled to the inner sleeve to prevent relative rotation between the cap and the combustor liner.

* * * * *